United States Patent [19]

Armes

[11] Patent Number: 4,699,739

[45] Date of Patent: Oct. 13, 1987

[54] GASOLINE ENGINE CHOKING ARRANGEMENT

[76] Inventor: Paul W. Armes, 2801 S. Rotherwood Ave., Evansville, Ind. 47714

[21] Appl. No.: 920,112

[22] Filed: Oct. 17, 1986

[51] Int. Cl.[4] ..... F02M 1/16

[52] U.S. Cl. ..... 261/64.6; 123/187.5 R; 261/DIG. 8

[58] Field of Search ..... 261/64.6, DIG. 8; 123/187.5 R

[56] References Cited

U.S. PATENT DOCUMENTS

| | | | |
|---|---|---|---|
| 1,088,854 | 3/1914 | Wadsworth | 123/187.5 R |
| 1,166,084 | 12/1915 | Ryder | 261/DIG. 8 |
| 2,764,393 | 9/1956 | Geyer | 261/64.6 |
| 3,345,045 | 10/1967 | Tuggle | 261/DIG. 8 |
| 3,415,236 | 12/1968 | Reichenbach et al. | 123/187.5 R |
| 3,494,343 | 2/1970 | Nutten | 261/DIG. 8 |
| 3,726,511 | 4/1973 | Jones | 261/64.6 |
| 4,404,933 | 9/1983 | Kuczenski | 261/DIG. 8 |

*Primary Examiner*—Tim Miles

*Attorney, Agent, or Firm*—Warren D. Flackbert

[57] ABSTRACT

A gasoline engine choking arrangement which serves as a modification to automatic chokes found in existing 9 and 11 cubic inch vertical shaft gasoline engines, i.e. an arrangement which achieves effective gasoline engine starting under both hot and cold conditions. A sleeve is provided to immobilize choke butterfly plate movement and, additionally, a primer assembly communicates with the fuel tank for selective gasoline flow. The aforesaid components, which may be merchandised in kit form, overcome flooding and consequent engine non-function which results, for example, from temperature variation and/or a stuck choke butterfly plate.

6 Claims, 6 Drawing Figures

30
19
30b'
30b
30c
30a'
30a
30d

30b'
17
30
14
12a'
12a
14a
12

25
17
29
20

14a 20b
20a
20

25
17
20
5
5
14a
29

6
6
14a
29

GASOLINE ENGINE CHOKING ARRANGEMENT

As is known, the usage of gasoline engines is widespread, typically, for example, in connection with power lawn mowers, such as those used for residential purposes. A particular difficulty, however, with gasoline engine usage lies in simple engine starting, where, oftentimes, the automatic choke used to power a majority of motors becomes immobile, causing engine flooding due to insufficient air passage. The remaining power mowers, i.e. those which do not include an automatic choke, employ a manual priming system or a manual choke system with a choke plate.

In any event, and in order to initiate gasoline engine operation, the user generally pulls a rope, i.e. a rope starter, to introduce gasoline and air into the engine cylinder. The fuel-air mixture is rich and, as stated, in most instances is controlled by means of an automatic choke; however, due to temperature variation and/or minimal use (the latter causing sticking), the conventional automatic choke sometimes passes insufficient air, resulting in flooding and, as a result, engine non-function.

The invention overcomes the preceding difficulties by eliminating the automatic choke forming part of the gasoline engine used on a majority of power mowers, the latter particularly identified as 9 and 11 cubic inch vertical shaft gasoline engines. The invention is not keyed for use with the remaining type of gasoline engines, i.e. those which do not include an automatic choke and/or have a float bowl with a needle and seat shut-off.

In this connection, and broadly, the invention employs an internally threaded sleeve to prop or maintain the choke butterfly plate in a fully opened position, where the preceding is accomplished after removal of the air cleaner. With the return of the air cleaner to an operative position and, thereafter, the removal of the fuel cap, and with fuel in the fuel tank, manual priming is accomplished by bellows extending from the filler neck of the fuel tank. Operation of the bellows, i.e. by depressing such, provides an extra urge or impetus for gasoline flow, meaning, importantly, effective starting under hot and/or cold conditions. In other words, starting problems are avoided.

In any event, a better understanding of the present invention will become more apparent from the following description, taken in conjunction with the accompanying drawing, wherein

Figures 1, 2, 3, 4, 5, 6:
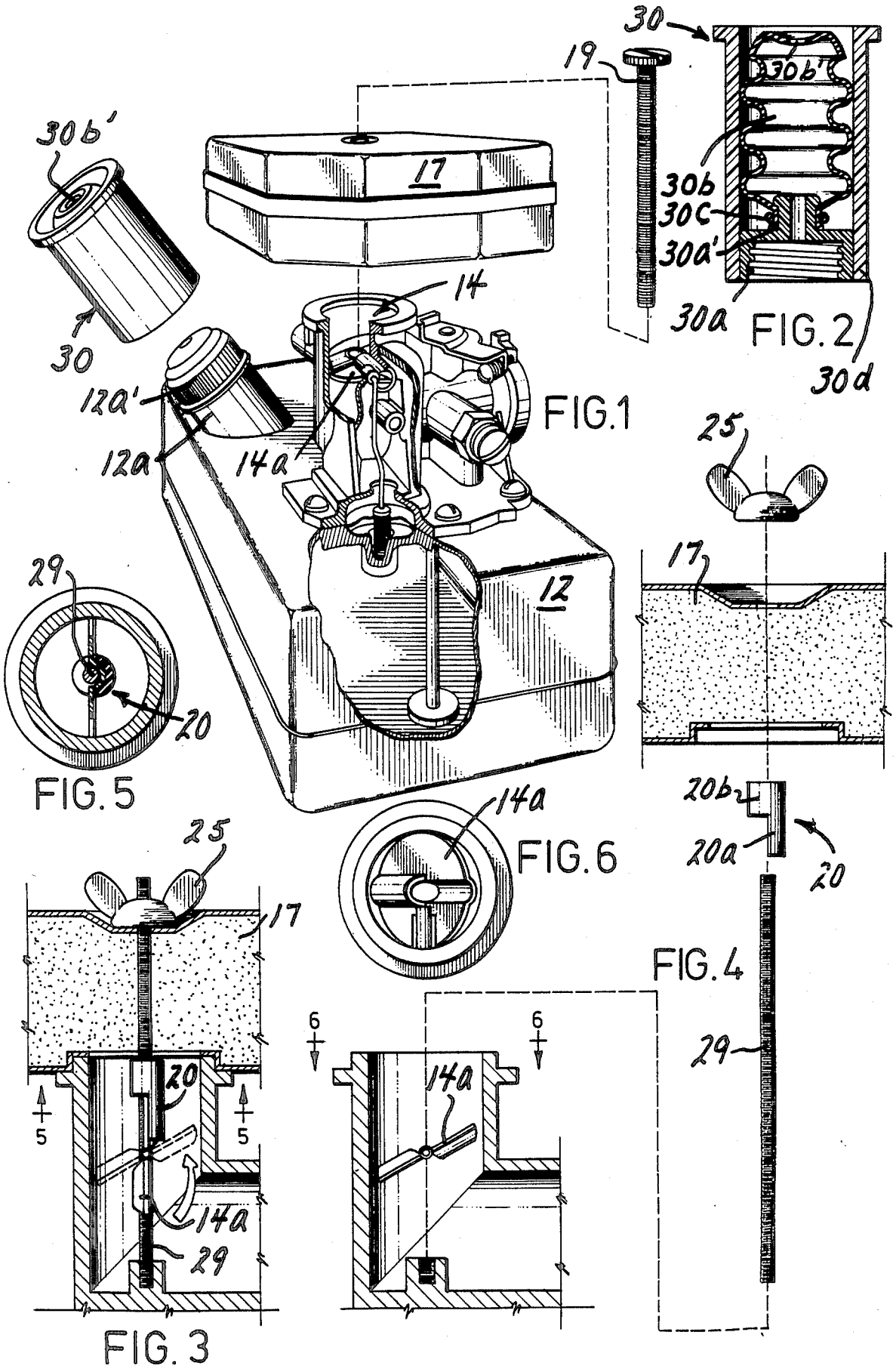
FIG. 1 is a perspective view of a portion of a gasoline engine used in accordance with the teachings of the present invention.
FIG. 2 is a view in vertical section detailing the bellows forming part of the invention.
FIG. 3 is another view in vertical section, but in this instance illustrating the assembled components of the manual choking or priming arrangement herein.
FIG. 4 is another view in vertical section, comparable to that of FIG. 3, but before the individual components are assembled.
FIG. 5 is a view in horizontal section, taken at line 5—5 on FIG. 3 and looking in the direction of the arrows, detailing the internally threaded sleeve forming part of the invention at a use condition; and, FIG. 6 is another view in vertical section, in this instance taken at line 6—6 on FIG. 4 and looking in the direction of the arrows, detailing the choke butterfly plate prior to an assembled and use condition.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, a portion of a conventional gasoline engine is disclosed, such being of the type generally used to power a majority of lawn mowers. The engine includes, among the usual basic components, a gasoline supply tank 12; a gasoline inlet 12*a* having a cap 12*a'*; an automatic choke 14 forming part of a carburetor assembly; and, a common air cleaner 17 with associated threaded center rod 19 for air cleaner placement. The automatic choke 14 disclosed in FIG. 1 is modified by the invention presented herein to achieve more effective engine starting.

In any event, the automatic choke 14 includes a pivotal choke butterfly plate 14*a* (see FIGS. 3 and 4). The importance of the invention lies, in part, in immobilizing choke butterfly plate 14*a* movement, where the preceding is accomplished through a sleeve 20, typically made from neoprene material, and defined by an elongated arcuate body 20*a* terminating in a closed upper end 20*b* through which a substitute center rod 29 is axially received. In other words, and as particularly evident in FIG. 3, placement of the sleeve 20 serves to fixedly locate the choke butterfly plate 14*a* in a generally vertical position, i.e. after movement thereof from the indicated phantom line position (see the arrow).

As stated, FIG. 1 shows the automatic choke 14 prior to modification, where, during modification (see FIG. 4), the air cleaner 17 is removed as well as existing center rod 19. Thereafter, substitute center rod 29 is inserted, with the sleeve 20 sliding downwardly along such (notched end first) until it props or maintains the choke butterfly plate 14*a* in a fully opened position (again see FIG. 3).

At this point, the air cleaner 17 is replaced (level against the air intake), where a wing nut 25 serves to maintain the preceding components in an assembled relationship. The choke 14 is now immobilized to an open condition by reason of the position of the pivotal choke butterfly plate 14*a*.

FIG. 2 illustrates a primer assembly 30 used in connection with the invention. The primer assembly 30 includes an internally threaded base 30*a*, where a pleated or flexible primer 30*b* is secured to a neck 30*a'* of the threaded base 30*a* and maintained in such position by a clamp 30*c*. The primer 30*b*, which is also made from a neoprene material, has an air vent 30*b'* at its upper end, and the body of the primer 30*b*, due to its accordian like flexible configuration, is susceptible to selective depressing and return. The primer assembly 30 is completed by a rigid outer sleeve 30*d*.

In achieving gasoline engine starting under hot/cold conditions, cap 12*a'*is removed from the gasoline inlet 12*a* and the primer assembly 30 secured to the latter.

Positioning of the primer assembly 30 is accomplished after fuel has been poured into the supply tank 12.

In any event, and at this time, in order to achieve engine starting, the user's thumb is placed over the air vent 30*b*'in the primer 30*b* and the primer 30*b* is depressed one or two times, serving to achieve selective gasoline flow. Inasmuch as the proper mixture of fuel-air is present, operation is initiated.

From the preceding, it should be evident that the gasoline engine choking arrangement herein has primary utility in connection with a 9 and 11 cubic inch vertical shaft gasoline engine which employs an automatic choke. The invention, which is basically characterized as a slidable sleeve movable, along a rod, into a locking relationship with a common pivotal choke butterfly plate, i.e. serves to fixedly locate the latter in a generally vertical or open position.

Additionally, and in order to achieve gasoline engine operation, a primer assembly is presented, where the latter is usable and/or positionable on the inlet to a fuel tank for the gasoline engine, and communicating with the latter. The primer assembly includes a primer which is movable to and from a depressed or flexed position, serving selective gasoline flow and assuring engine starting under both hot and cold conditions.

The invention is marketable in kit form, where a consumer can modify an existing automatic choke in a simple and direct manner, i.e. a modification which involves no major structural changes. Thus, the invention presents simple adaptability and effectively overcomes choke butterfly plate sticking and subsequent engine flooding.

The arrangement described hereabove is susceptible to various changes within the spirit of the invention, including, for example, the configuration of the sleeve; the particular form of primer assembly employed; overall proportioning; and, the like. Thus, the preceding should be considered illustrative and not as limiting the scope of the following claims:

I claim:

1. In combination with a gasoline engine including a fuel tank having a fuel inlet and outlet, an automatic choke having a pivotal choke butterfly plate, an air filter, and a rod mounting said air filter, a choking arrangement comprising means immobilizing said pivotal choke butterfly plate at an open position and means communicating with said fuel inlet selectively urging fuel passage from said fuel tank outlet during gasoline engine starting.

2. The arrangement of claim 1 where said immobilizing means is a sleeve slidable on said rod for said air filter into blocking engagement with said pivotal choke butterfly plate.

3. The arrangement of claim 2 where said sleeve includes a notched lower end.

4. The arrangement of claim 2 where said sleeve props said pivotal choke butterfly plate at a generally vertical fully opened position.

5. The arrangement of claim 1 where said communicating means is a bellows operative by flexing movement.

6. The arrangement of claim 1 where said communicating means is a primer releasably secured to said fuel inlet.

* * * * *